US012644269B2

(12) United States Patent
Adams et al.

(10) Patent No.: US 12,644,269 B2
(45) Date of Patent: Jun. 2, 2026

(54) PLASTIC CLOSET CARRIER FITTING

(71) Applicant: Sioux Chief Mfg. Co., Inc., Kansas City, MO (US)

(72) Inventors: Cory Adams, Raymore, MO (US); Brian E. Ismert, Belton, MO (US); Christopher J. Ismert, Kansas City, MO (US); Jeremiah T. Winnat, Garden City, MO (US)

(73) Assignee: Sioux Chief Mfg. Co., Inc., Kansas City, MO (US)

( * ) Notice: Subject to any disclaimer, the term of this patent is extended or adjusted under 35 U.S.C. 154(b) by 75 days.

(21) Appl. No.: 18/361,364

(22) Filed: Jul. 28, 2023

(65) Prior Publication Data

US 2024/0035268 A1 Feb. 1, 2024

Related U.S. Application Data

(60) Provisional application No. 63/369,878, filed on Jul. 29, 2022.

(51) Int. Cl.

| | |
|---|---|
| ***E03D 11/14*** | (2006.01) |
| ***E03D 9/04*** | (2006.01) |
| ***E03D 11/13*** | (2006.01) |

(52) U.S. Cl.

CPC ..... *E03D 11/143* (2013.01); *E03D 9/04* (2013.01); *E03D 11/135* (2013.01)

(58) Field of Classification Search

CPC ..... E03D 11/14; E03D 11/143

See application file for complete search history.

(56) References Cited

U.S. PATENT DOCUMENTS

| | | | | |
|---|---|---|---|---|
| 3,078,477 | A * | 2/1963 | Schmid | E03D 11/14 4/252.3 |
| 3,098,242 | A | 7/1963 | Armbruster et al. | |
| 4,185,334 | A | 1/1980 | Izzi | |
| 6,928,669 | B2 * | 8/2005 | Akin | E03D 11/14 4/252.5 |
| 6,979,027 | B2 | 12/2005 | Hetzler et al. | |
| 8,141,177 | B1 * | 3/2012 | Majocka | E03D 11/14 4/252.2 |

(Continued)

FOREIGN PATENT DOCUMENTS

| | | |
|---|---|---|
| EP | 0898023 A2 | 2/1999 |
| EP | 3401452 A1 | 11/2018 |

(Continued)

*Primary Examiner* — Christine J Skubinna

(74) *Attorney, Agent, or Firm* — AVEK IP, LLC; Kent R. Erickson

(57) ABSTRACT

A water closet carrier assembly is used for supporting a wall-mounted toilet and flow connecting the wall-mounted toilet to a waste drain line. The water closet carrier assembly includes a faceplate having a front face with a drain opening that sealingly joins to a distal end of a closet carrier nipple. A second distal end of the closet carrier nipple sealingly joins to a wall-mounted toilet. The faceplate is adjustably joined to an anchoring system that replaces traditional systems connected to the drain body fitting. Opposingly directed from the front face of the faceplate, a rear face aligns and sealingly joins the drain opening to an ovate inlet of a drain body fitting molded from plastic. The drain body fitting sealingly joins and directs effluent to the waste drain line.

21 Claims, 11 Drawing Sheets

(56) References Cited

U.S. PATENT DOCUMENTS

| | | | | |
|---|---|---|---|---|
| 10,895,070 | B2 * | 1/2021 | Hodge | E03D 11/135 |
| 2019/0316337 | A1 * | 10/2019 | Hetzler | E03D 1/26 |
| 2020/0224400 | A1 * | 7/2020 | Fratantonio | F16B 7/20 |
| 2022/0243445 | A1 | 8/2022 | Lawrence et al. | |
| 2023/0175244 | A1 | 6/2023 | Say et al. | |

FOREIGN PATENT DOCUMENTS

| | | | |
|---|---|---|---|
| FR | 2883011 | B1 | 11/2008 |
| WO | 2009017391 | A1 | 2/2009 |
| WO | 2013041745 | A1 | 3/2013 |
| WO | 2016162352 | A1 | 10/2016 |

* cited by examiner

PLASTIC CLOSET CARRIER FITTING

CROSS-REFERENCE TO RELATED APPLICATIONS

This application claims the benefit of U.S. Provisional Patent Application No. 63/369,878 filed Jul. 29, 2022, the disclosure of which is hereby incorporated herein in its entirety by reference.

BACKGROUND OF THE INVENTION

Field of the Invention

This invention relates to a water closet carrier assembly for a wall-mounted toilet.

Background

Wall-mounted toilets are frequently used in commercial buildings having concrete floors and restrooms with multiple toilets to limit the number of drain openings to be cut through the concrete slab.

Wall-mounted toilets, which are connected to a waste drainpipe through a wall rather than the floor, require a strong support structure positionable behind the wall and to which the toilet may be mounted. The support structure, which is typically referred to as a water closet carrier assembly, is most commonly fabricated from cast iron, which is heavy and durable, but bulky, expensive and awkward to install. In commercial installations, in which a series of toilets are mounted on a wall in a restroom, a drain line fitting connecting a drain line from the toilet to the waste drain pipe behind the wall must be installed at progressively lower heights to aid gravity driven flow of effluent. The height of the drain line fitting therefore must be vertically adjustable relative to the water closet carrier assembly. Once installed, the weight of the cast iron assembly in addition to a rear support anchor on the drain body fitting prevents the water closet carrier assembly from movement due to the load of the toilet and user.

In view of the statements above, there is a need for a water carrier assembly that can be easily transported to and installed at the site, yet is stable when installed and loads are applied.

SUMMARY OF THE INVENTION

This invention relates to a water carrier assembly for supporting a wall-mounted toilet and flow connecting the wall-mounted toilet to a waste drain line. The water carrier assembly includes a faceplate having a front facing flanged drain opening that sealingly joins a closet carrier nipple and a rear facing drain opening that sealingly joins to an ovate inlet in a drain body fitting.

According to one aspect of the invention, a plastic formed drain body fitting directs effluent to the waste drain line. The drain body fitting incorporates overmolded metal nuts for joining the plastic formed drain body fitting to the faceplate of dissimilar material. An elastomeric seal with integrated ovate gaskets sealingly and vertically adjustably joins the rear facing drain opening of the faceplate to the ovate inlet with integrated ovate grooves on the drain body fitting. The drain body fitting incorporates a molded plastic vent aperture hub that can be directly connected to a plumbing vent system. A sump and throat sections of the drain body fitting angle the effluent approximating a near direct path in the direction of the flow of the waste drain line.

According to another aspect of the invention, the water carrier assembly is secured by first and second legs that are joined to first and second feet. The faceplate is adjustably secured to first and second legs on the left and right side of the faceplate, respectively. The legs include vertically extending mounting flanges with vertically oriented slots for securing the faceplate at a desired height. The legs are interchangeable. Projections on the legs engage with a receiver slot formed on a vertical mount of the first and second feet. A threaded fastener in a threaded hole on the vertical mount on each of the first and second feet engages with and secures the position of the projection on each of the respective left and right legs. The vertical mount of the first and second feet is integrally formed with a horizontally extending base and reinforced by a support gusset. The first and second feet and the first and second legs are anchored to the floor or building framing to prevent vertical and horizontal movement of the water closet carrier assembly. The anchors are positioned on projections such that they are directly accessible from above.

DETAILED DESCRIPTION OF THE PREFERRED EMBODIMENTS

Figure 1:
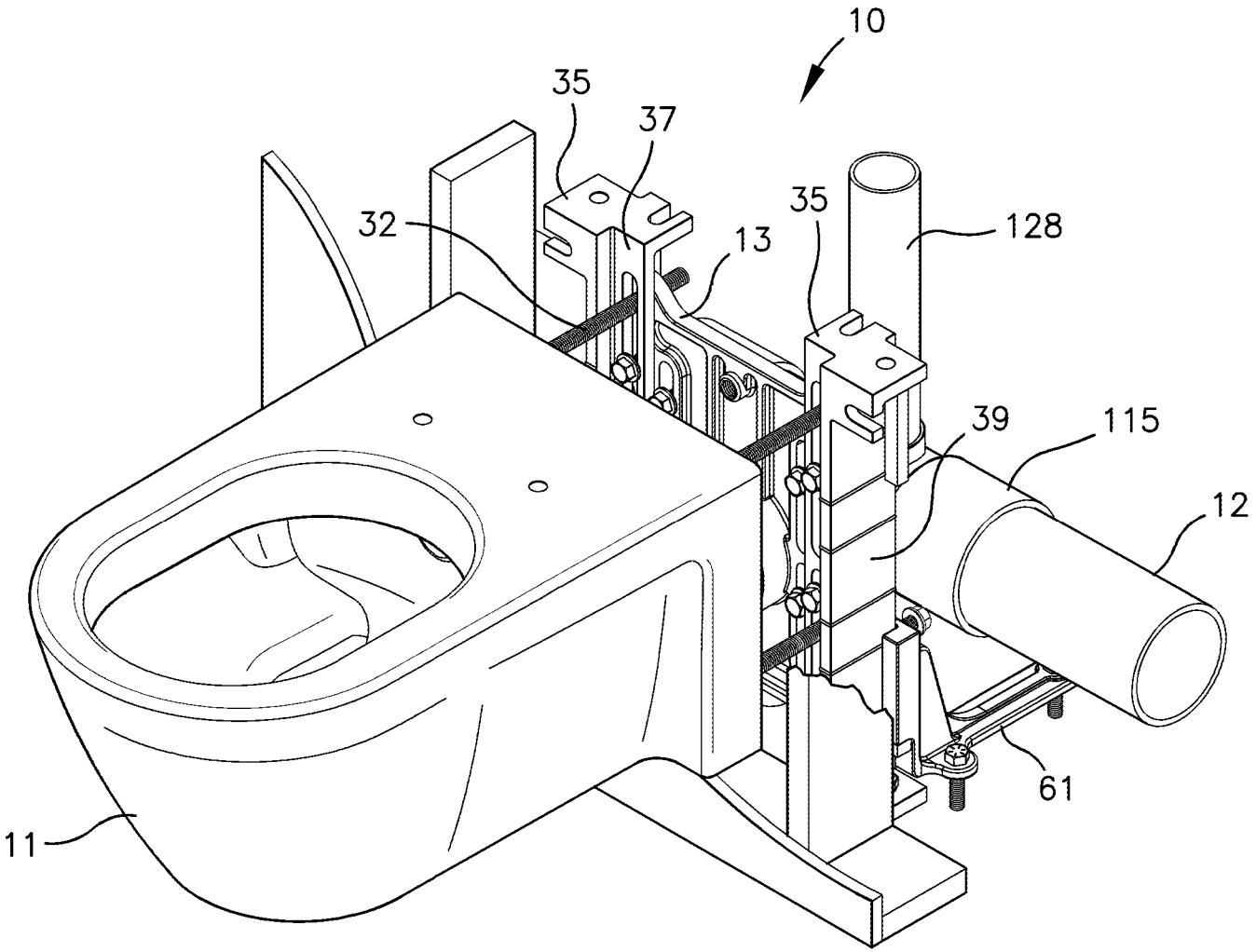
FIG. 1 is front, perspective view of a toilet supported on one embodiment of a water closet carrier assembly mounted behind a wall against which the toilet is mounted and with portions of the wall removed to show details of the water closet carrier assembly.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. The words "forwardly" and "rearwardly" will refer to the directions toward and away from, respectively, the relative location of the toilet. Said terminology will include the words specifically mentioned, derivatives thereof and words of a similar import.

A water closet carrier assembly 10 is used for supporting a wall-mounted toilet and flow connecting the wall-mounted toilet 11 to sections of a waste drain line 12. Referring to FIGS. 1-4, the water closet carrier assembly 10 includes a faceplate 13 supported on first and second legs 35 with a toilet drain pipe or closet carrier nipple 17 secured to and projecting forward form the faceplate 13 in flow communication with an effluent outlet of the toilet 11 and a drain body fitting 21 secured to and projecting rearward from the faceplate 13 in flow communication with the waste drain line 12. First and second support brackets or feet 60 and 61 are securable to the bottoms of the first and second legs 35 respectively and adapted to be bolted to a concrete floor or slab for securing the closet carrier assembly 10 in place.

Figure 3:
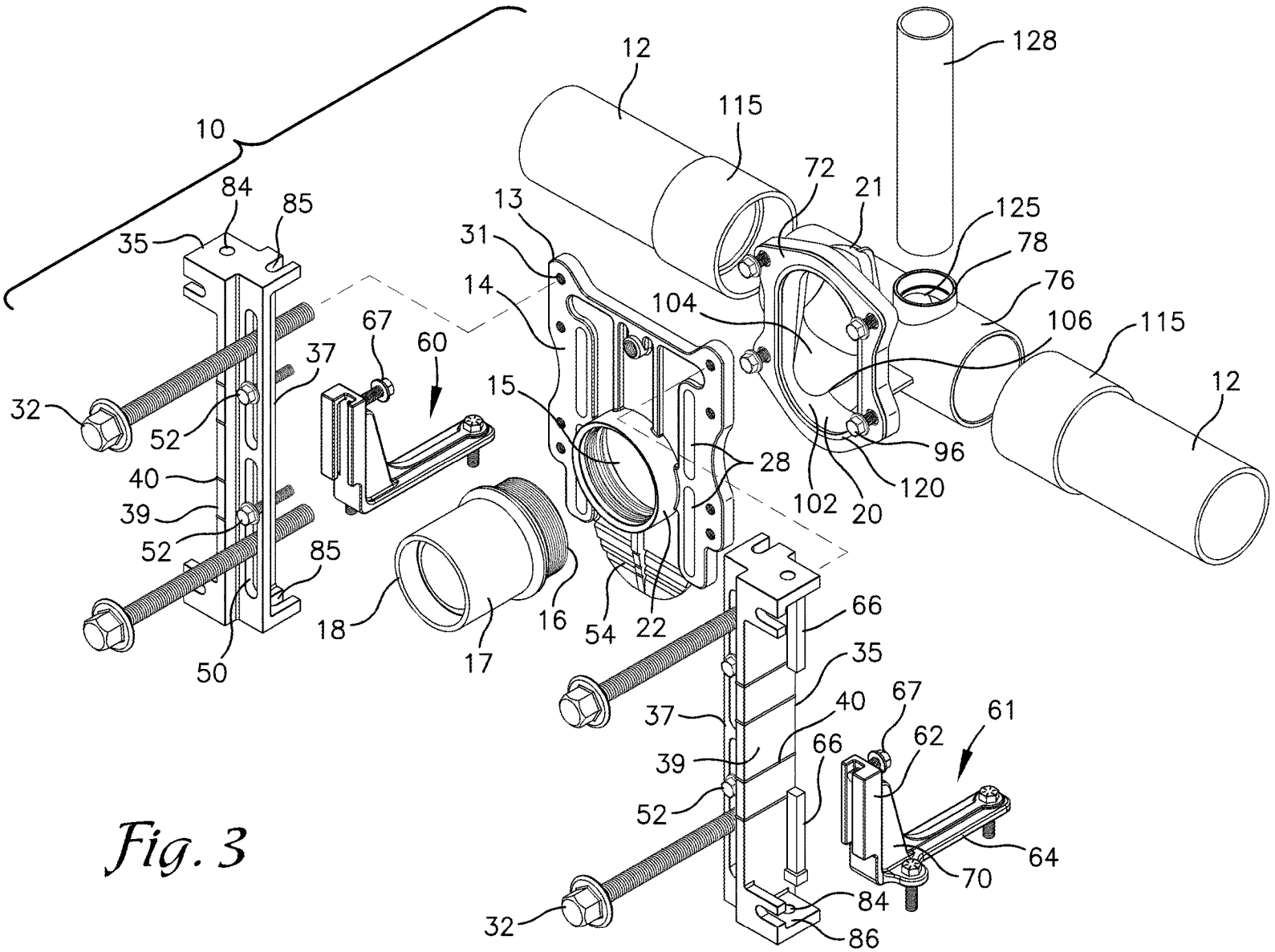
FIG. 3 is an exploded, front perspective view of the water closet carrier assembly in FIG. 2.
Figure 4:
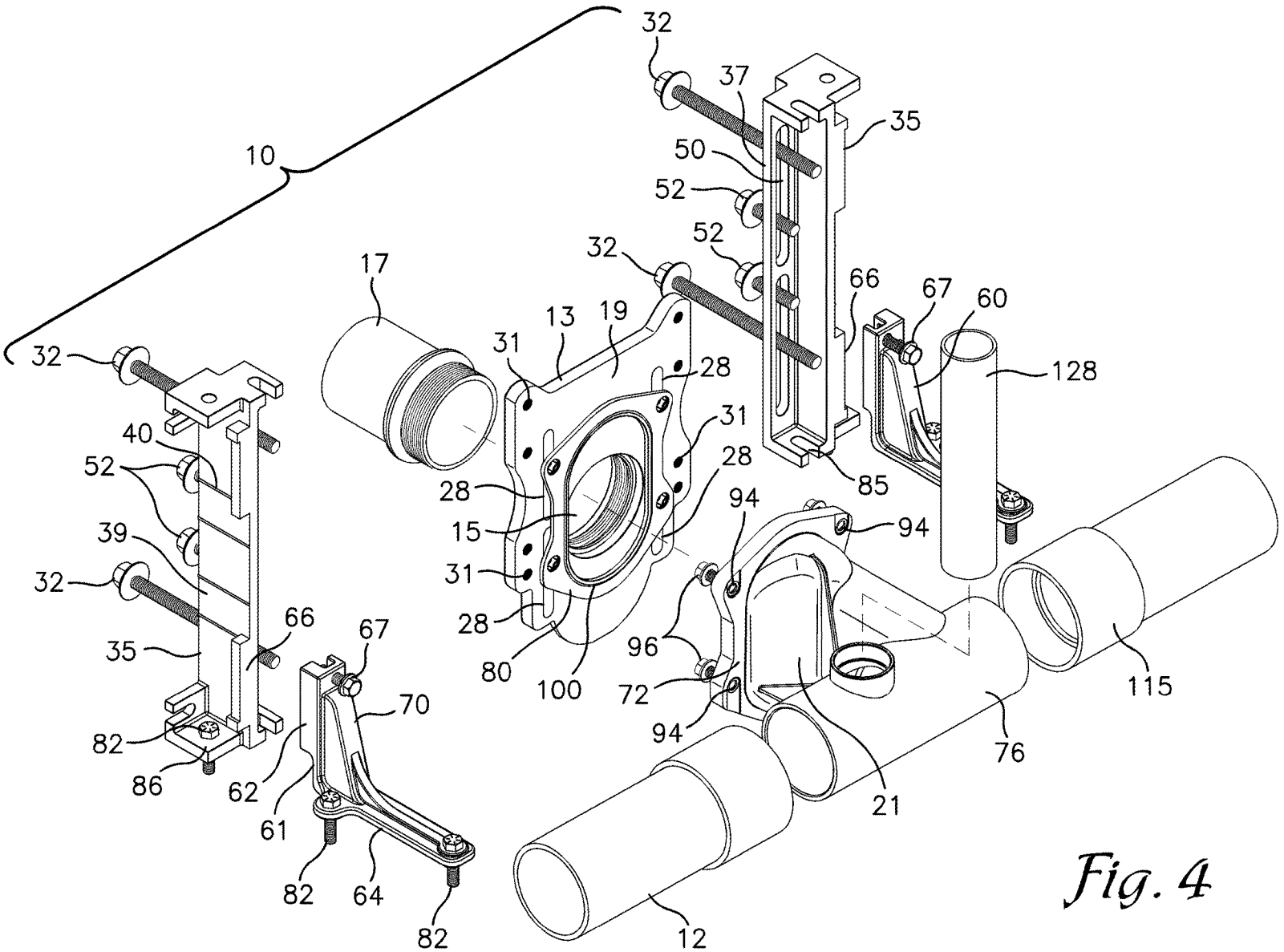
FIG. 4 is an exploded, rear perspective view of the water closet carrier assembly in FIG. 2.

The faceplate 13 includes a front face 14 and an oppositely directed rear face 19 with a drain opening 15 extending through the faceplate 13 from the front face 14 to the rear face 19. An outlet distal end 16 of the closet carrier nipple 17 is threadingly secured in the drain opening 15 of faceplate 13. An inlet end 18 of the closet carrier nipple 17 is sealingly connected to the effluent opening of the wall-mounted toilet 11. The faceplate 13 is adjustably joined to legs 35 for adjusting the vertical position of the faceplate 13 relative to the legs 35. Similarly, the drain body fitting 21 is adjustably secured to the faceplate 13 to permit vertical adjustment of the drain body fitting 21 relative to the faceplate 13. Referring to FIGS. 3 and 4, the drain body fitting 21 includes an ovate inlet opening 20 with a longer axis oriented vertically to permit vertical adjustment of the drain body fitting 21 relative to the round drain opening 15 formed in the faceplate 13. The width of the ovate inlet opening 20 is equal to or exceeds the diameter of the drain opening 15 so that the ovate inlet 120 fully encloses the drain opening 15.

The drain opening 15 of the faceplate 13 is formed in an internally threaded nipple receiver or collar 22 extending transversely from the front face 14 of the faceplate 13. The outlet distal end 16 of the externally threaded closet carrier nipple 17 is threadingly couplable within the threaded collar 22. An O-ring may be positioned within a circumferential groove within the threaded collar 22 to create a seal. In another embodiment, an O-ring may be positioned within a circumferential groove formed around the outer circumference of the nipple 17 to create a seal when the nipple 17 is threaded into and engaged with the collar 22.

Figure 2:
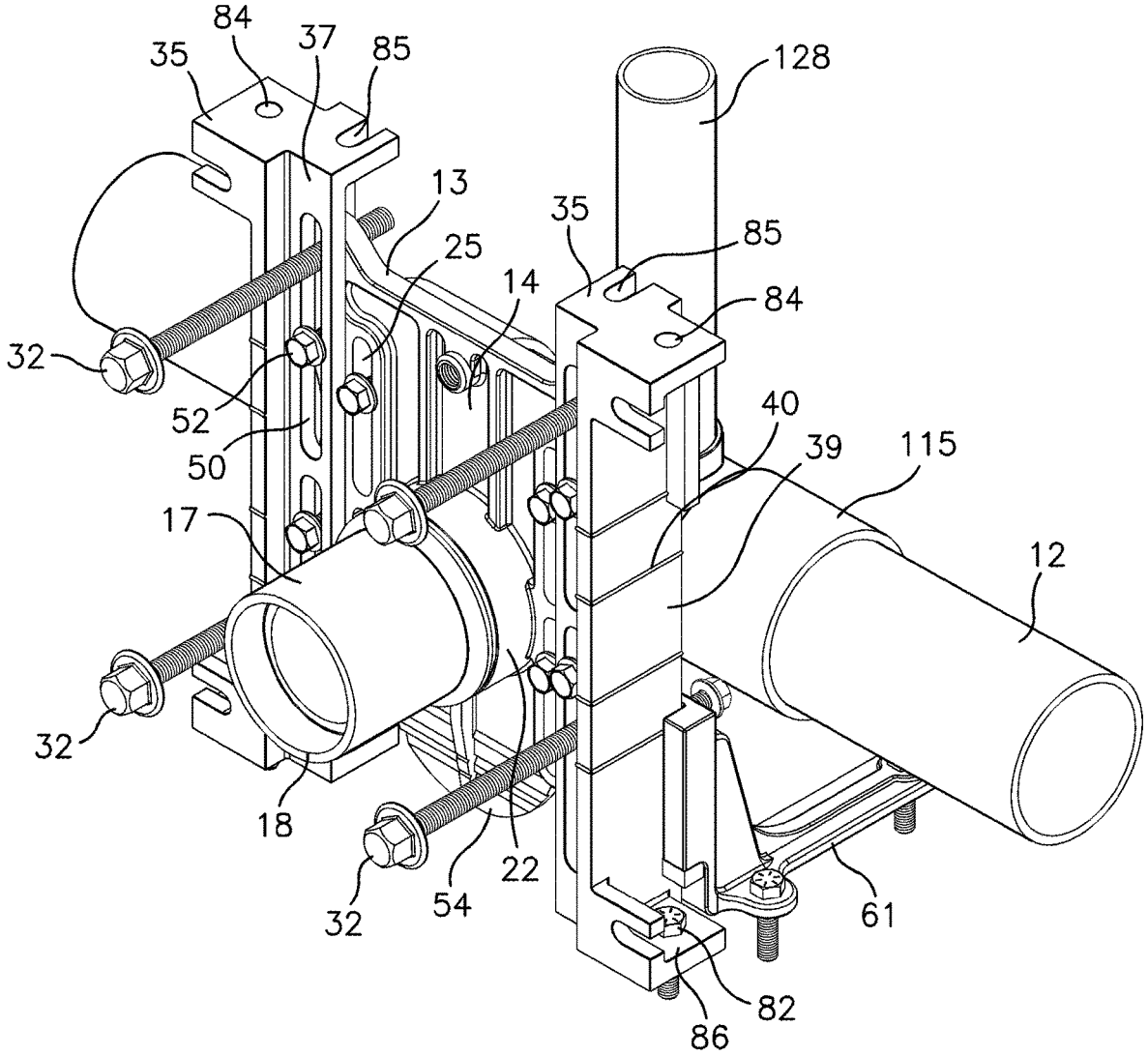
FIG. 2 is a front, perspective view of the water closet carrier assembly connected to a drain line as shown in FIG. 1, but with the toilet and wall removed.

As best seen in FIGS. 2-4, first and second vertically aligned sets of vertically oriented fitting slots 28 extend through the faceplate 13 on the left and the right sides respectively of the drain opening 15 for receiving fitting securement bolts 96 for adjustably joining the drain body fitting 21 to the faceplate 13. In the preferred embodiment, the faceplate 13 includes two vertically oriented fitting slots 28 extending therethrough on opposite sides of the drain opening 15. As seen in FIG. 3, on the faceplate 13 a plurality of threaded securing holes 31 extend therethrough on each of the respective left and the right sides of the first and second vertically aligned sets of vertically oriented fitting slots 28 on the left and right sides of the drain opening 15 for securing and supporting the toilet 11 and an anchoring system including legs 35 and feet 60 and 61 to the faceplate 13.

Referring to FIG. 2, the faceplate 13 is adjustably supported by first and second legs 35 joined on the respective left and right sides of the faceplate 13 such that the height of the faceplate 13 and the height of the closet carrier nipple 17 secured thereto is adjustable, and thus the toilet 11 height, is adjustable. The first and second legs 35 each have a vertically extending mounting flange 37 securable against the front face 14 or rear face 19 of the faceplate 13 along the left and right sides thereof, and the first and second legs 35 each have a transverse support flange 39 extending transverse to the vertically extending mounting flange 37 and marked with standard toilet heights 40. The vertically extending mounting flange 37 of the first and second legs 35 each has at least one vertically oriented slot 50 formed therethrough and aligned with the threaded securing holes 31 on the respective left and right sides of the faceplate 13. In the preferred embodiment each vertically extending mounting flange 37 has two vertically aligned, vertically oriented slots 50 formed therethrough which are aligned with upper and lower pairs of threaded securing holes 31 on the respective left and right sides of the faceplate 13. At least two leg bolts 52 are insertable through each set of vertically aligned, vertically oriented slots 50 on each of the vertically extending mounting flanges 37 and aligned with the threaded securing holes 31 of the faceplate 13, securing each of the first and second legs 35 to the faceplate 13 on the left and right sides thereof, so that the height of the faceplate 13 relative to the first and second legs 35 is adjustable. In the embodiments shown, break-away sections 54 of the faceplate 13 enable adjusting the height of the faceplate 13 relative to the first and second legs 35. In the preferred embodiment the first and second legs 35 are designed to be interchangeable by flipping the top of the leg to the bottom for use on an alternate side of the faceplate 13.

Toilet mounting bolts 32 are extendable through the vertically aligned, vertically oriented slots 50 on each of the vertically extending mounting flanges 37 aligned with the threaded securing holes 31 on the respective left and right sides of the faceplate 13. The toilet mounting bolts 32 secure and support the wall-mounted toilet relative to the faceplate 13, with the bathroom wall interposed therebetween, to anchor and minimize movement of the toilet 11.

Figure 10:
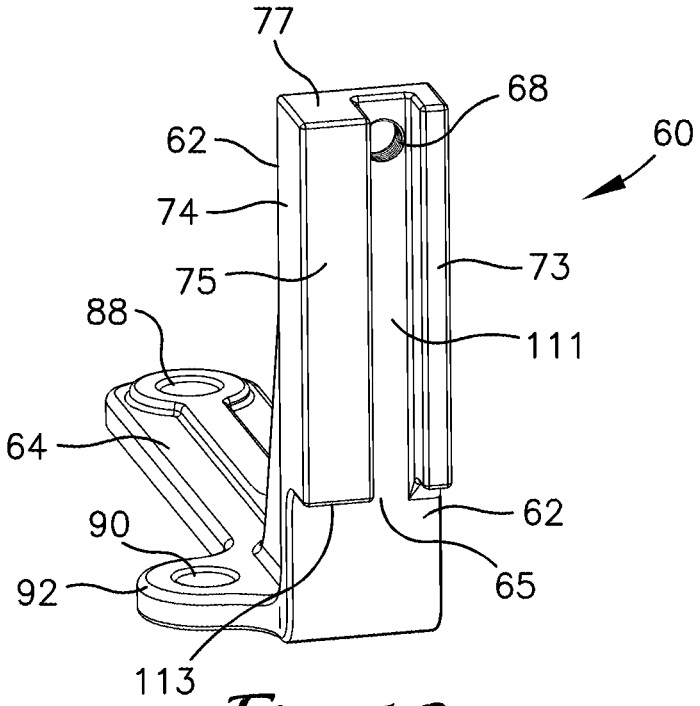
FIG. 10 is a front perspective view of a left foot of the water closet carrier assembly in FIG. 2 illustrating details of a front face and a horizontally extending base of the left foot.
Figure 11:
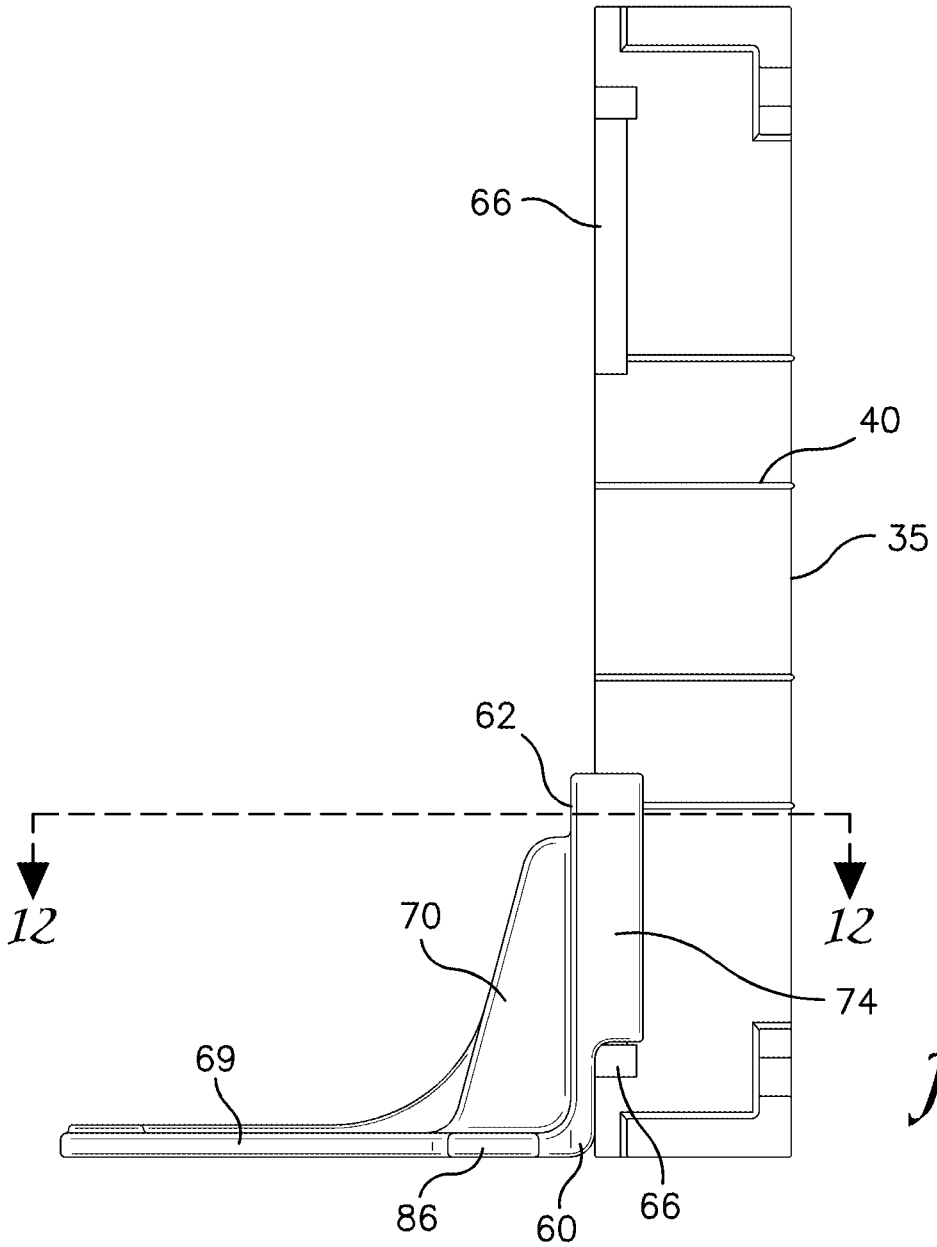
FIG. 11 is a side, elevation view of the left foot attached to a leg of the water closet carrier assembly in FIG. 2.
Figure 12:
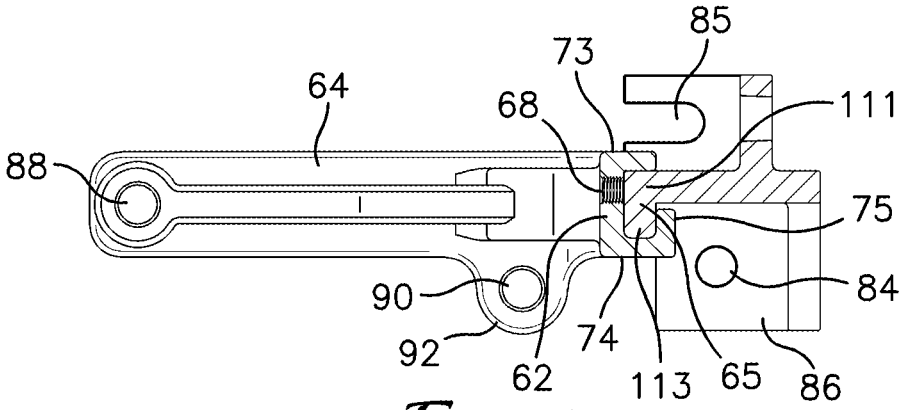
FIG. 12 is a top, cross-sectional view of the left foot attached to the leg of the water closet carrier assembly in FIG. 11 taken along a horizontal plane corresponding to line 12-12 of FIG. 11, viewed from the top and illustrating the left foot mounted on the leg and the relationship therebetween.

Referring to FIGS. 2-4, first and second feet 60 and 61 are removably securable to the first and second legs 35, respectively. Each of the first and second feet 60 and 61 includes a vertical mounting member 62 integrally formed with and extending transverse to a horizontally extending base 64 with a reinforcing gusset 70 integrally formed with and extending between the respective vertical mounting member 62 and horizontally extending base 64. As best seen in FIGS. 10-12, each vertical mounting member 62 includes an L-shaped, projection receiving slot 65 sized to receive and engage a leg projection 66 formed on and projecting laterally outward from a rear edge of a respective transverse support flange 39 of the first and second legs 35 with the horizontally extending base 64 extending rearward relative to the faceplate 13 and leg 35 to which it is attached. The projection receiving slot 65 is formed on a front face of the vertical mounting member 62 and includes a vertically extending groove 111 which is open on upper and lower ends thereof and sized just wider than the width of the transverse support flange 39 such that each of the first and second feet 60 and 61 may be positioned against a rear edge of a respective transverse support flange 39 with the rear edge of the transverse support flange received in the vertically extending groove 111 to permit the vertical mounting member 62 of foot 60 and 61 to slide vertically relative to the transverse support flange 39.

The groove 111 is bounded on one side or inner side by a forwardly projecting, inner sidewall 73 and on an opposite, outer side by an overhanging member or forwardly spaced flange wall 75 supported in forwardly spaced relation from a front face of the vertical mounting member 62 by a forwardly projecting, outer sidewall 74. A laterally extending groove 113 is formed between the front face of the vertical mounting member 62 and a rear face of the forwardly spaced flange wall 75 with the laterally extending groove 113 opening laterally or outwardly to the vertically extending groove 111. An upper end of the laterally extending groove 113 is closed off by a top wall 77 connected between the vertical mounting member 62 and forwardly spaced flange wall 75. A lower end of the laterally extending groove 113 is open relative to a bottom of the flange wall 75. With the foot 60 and 61 positioned against a rear edge of the transverse support flange 39 above the outwardly extending leg projection 66 and with the rear edge extending into the forwardly facing groove 111, the foot 60 and 61 may be slid downward such that the leg projection 66 advances into the laterally extending groove 113 of the foot 60 and 61 until the base 64 of the foot 60 and 61 extends in alignment with a lower end of the leg 35.

A threaded fastener, such as a set screw 67, may then be threaded into a threaded hole 68 in vertical mounting member 62 of the foot 60 and 61 until the end engages a rear face of the transverse support flange 39 or leg projection 66 of leg 35. Further threaded advancement of the set screw 67 toward the rear face of the transverse support flange 39 or leg projection 66 draws the rear face of the flange wall 75 against a front face of the leg projection 66 to clamp the foot 60 and 61 against the leg projection 66 of the leg 35 for securing the foot 60 and 61 to the leg 35. It is foreseen that the feet 60 and 61 and legs 35 may be configured so that the horizontally extending base 64 of each foot 60 and 61 projects forward of the leg 35 to which it is attached or in other directions transverse to the leg 35 to which the foot 60 or 61 is attached.

Figure 5:
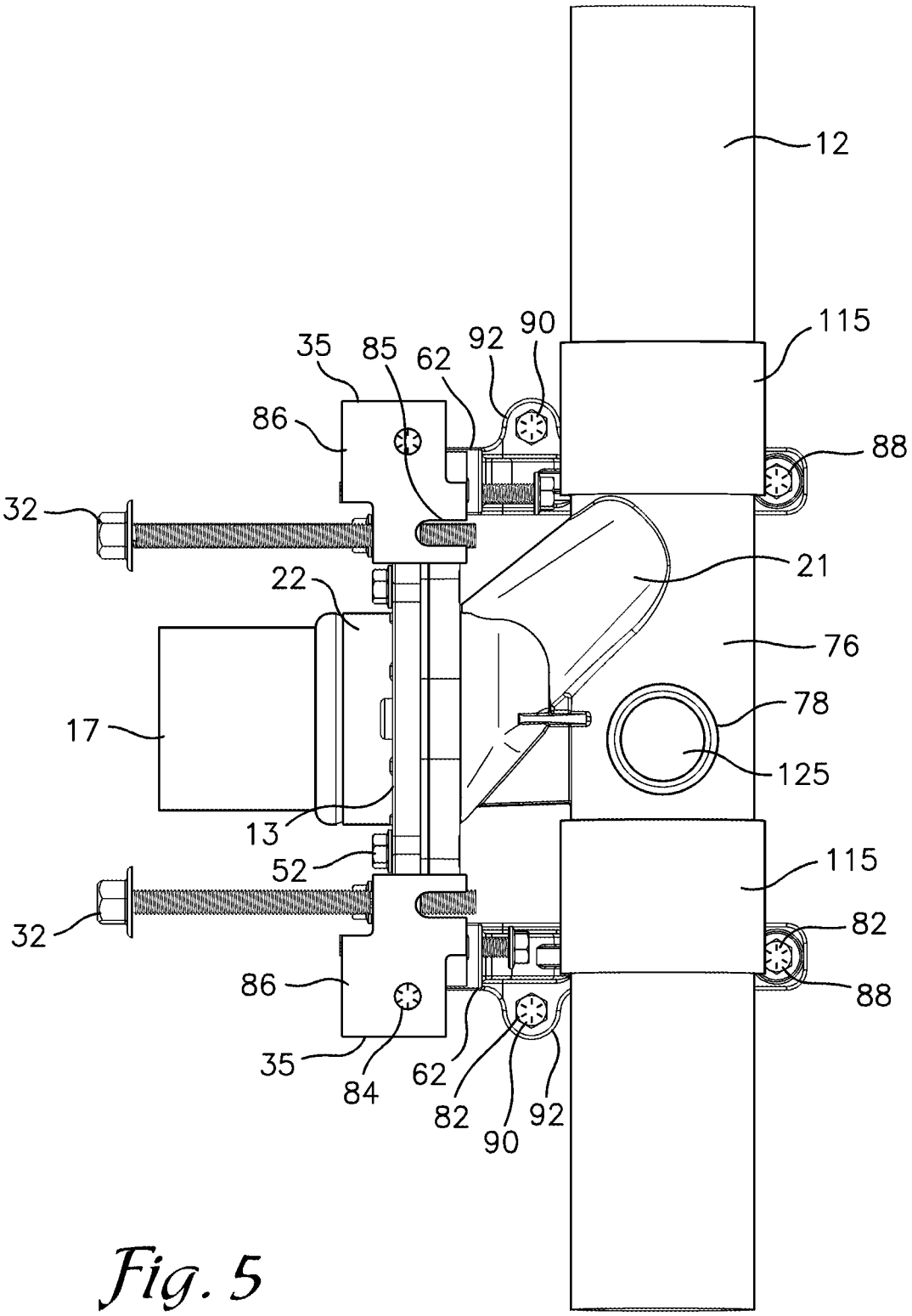
FIG. 5 is a top, perspective view of the water closet carrier assembly in FIG. 2 illustrating the position of anchoring bolts from above.
Figure 6:
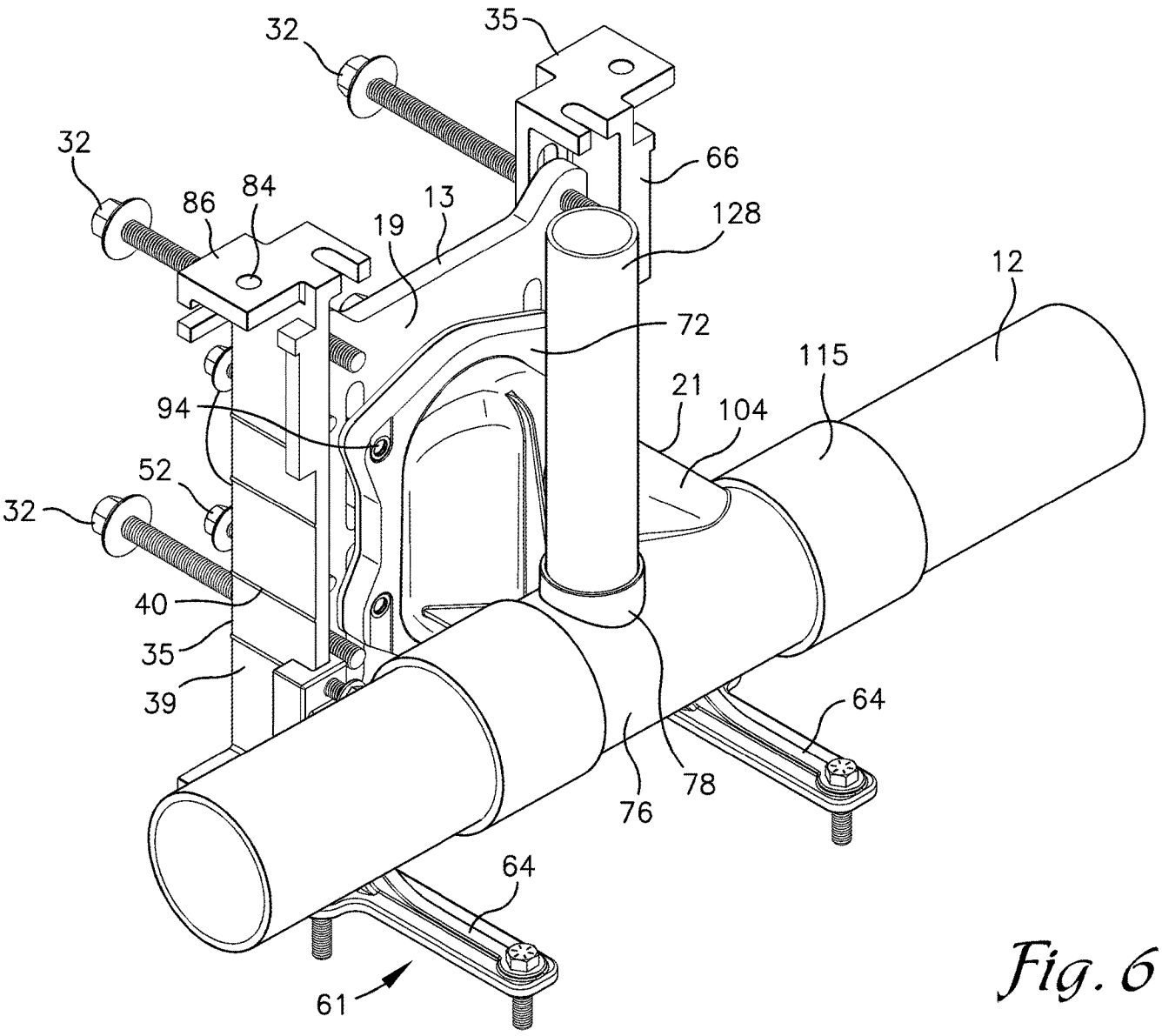
FIG. 6 is a rear, perspective view of the water closet carrier assembly in FIG. 2.
Figure 7:
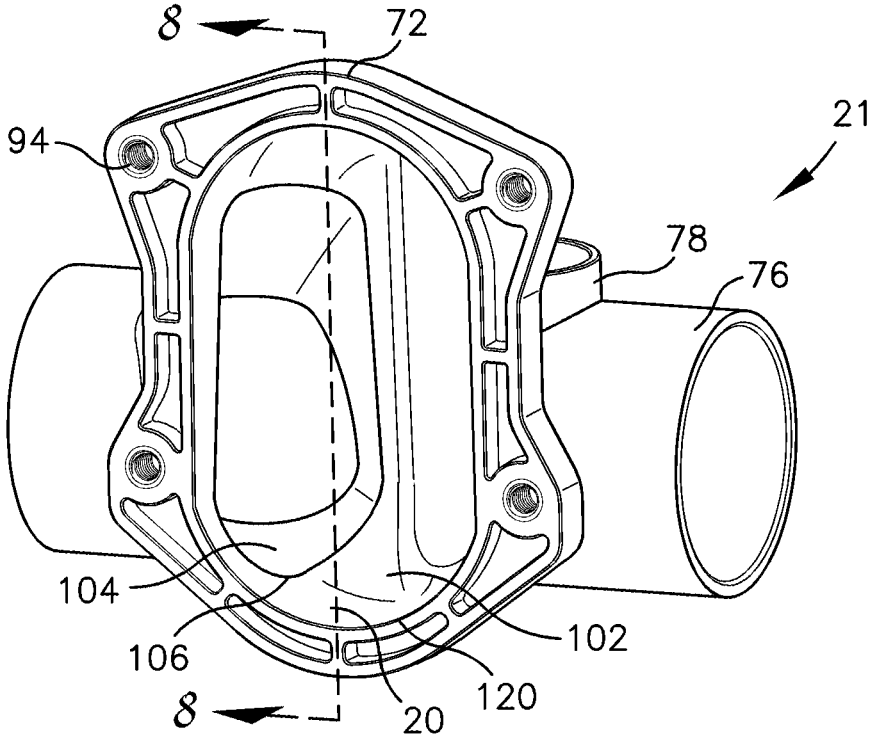
FIG. 7 is a front, perspective view of a drain body fitting of the water closet carrier assembly in FIG. 2 illustrating details of a mounting flange and an ovate inlet.
Figure 8:
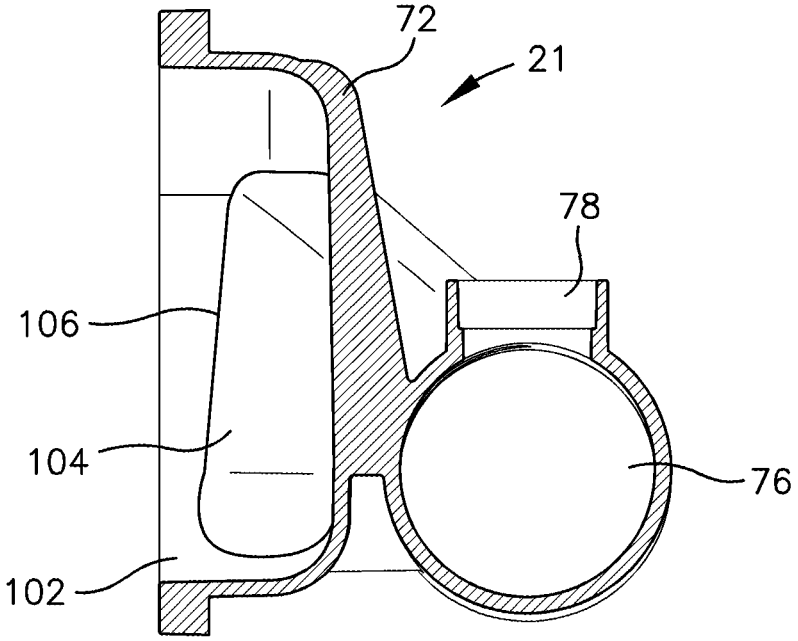
FIG. 8 is a cross-sectional view of the drain body fitting in FIG. 7 taken along a longitudinal plane corresponding to line 8-8 of FIG. 7, viewed from the right.
Figure 9:
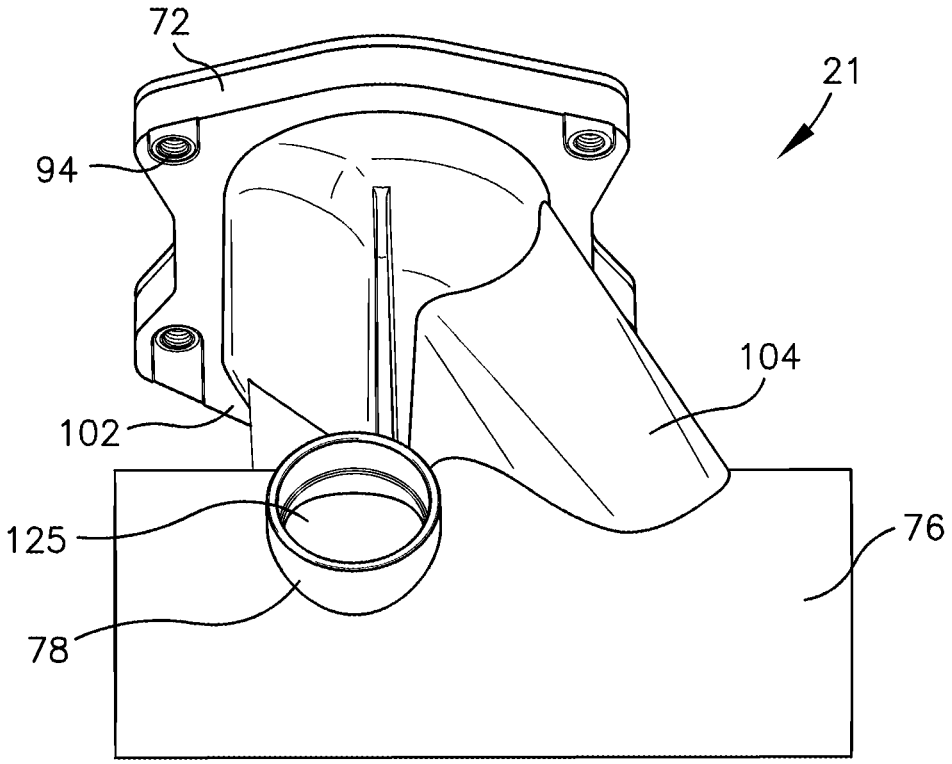
FIG. 9 is a top, rear, perspective view of the drain body fitting of the water closet carrier assembly in FIG. 2.

As best seen in FIGS. 2-4 at least one leg anchoring hole 84 or anchoring slot 85 for receiving anchor bolts 82 is formed in an anchoring base 86 extending horizontally transverse from one or both sides of the transverse support flange 39 of each of the first and second legs 35 at each end thereof. One or more foot anchoring holes or slots for receiving anchor bolts 82, such as rear foot anchoring hole 88 and forward foot anchoring hole 90 are formed in the horizontally extending base 64 of each of the first and second feet 60 and 61. In a preferred embodiment as shown in FIG. 5, the rear foot anchoring hole 88 is formed in a distal end of the horizontally extending base 64 and spaced rearward from the vertical mounting member 62 a distance greater than the diameter or width of the drain body fitting 21 secured to the faceplate 13 such that an anchor bolt 82 inserted into the rear anchoring hole 88 can be accessed with a driver from above the assembly during installation and access to the anchor bolt 82 is not obstructed by the fitting 21. Forward foot anchoring hole 90 is formed in an outwardly extending tab or projection 92 at the base of each of the vertical mounting member 62 so that an anchor bolt 82 inserted therein can be accessed with a driver from above the assembly during installation and access to the anchor bolt 82 is not obstructed by the fitting 21. The spacing between the rear foot anchoring hole 88 and the front foot anchoring hole 90 is greater than the diameter of the waste drain line connection conduit 76 and the drain lines 12 connected thereto and the diameter of an elastomeric coupler 115 connecting ends of the waste drain line connection conduit 76 to drain lines 12.

Referring to FIGS. 6-9, the drain body fitting 21 includes an ovate inlet 120 surrounding the ovate inlet opening 20, the mounting flange 72 projecting radially outward from the ovate inlet 120 and a throat section 104 flow connecting the ovate inlet 120 to the waste drain line connection conduit 76. The ovate inlet 120, the mounting flange 72, the throat section 104 and the waste drain line connection conduit 76 are integrally formed as a single plastic part and may be formed from acrylonitrile butadiene styrene (ABS), polyvinyl chloride (PVC) or another plastic or combination of plastics foreseen by a person having ordinary skill in the art. In an embodiment, the plastic part is formed by a molding process. It is foreseen that drain body fitting 21 may be formed from separate components secured together. In an embodiment, the drain body fitting 21 may be formed separate from the waste drain line connection conduit 76.

Figure 13:
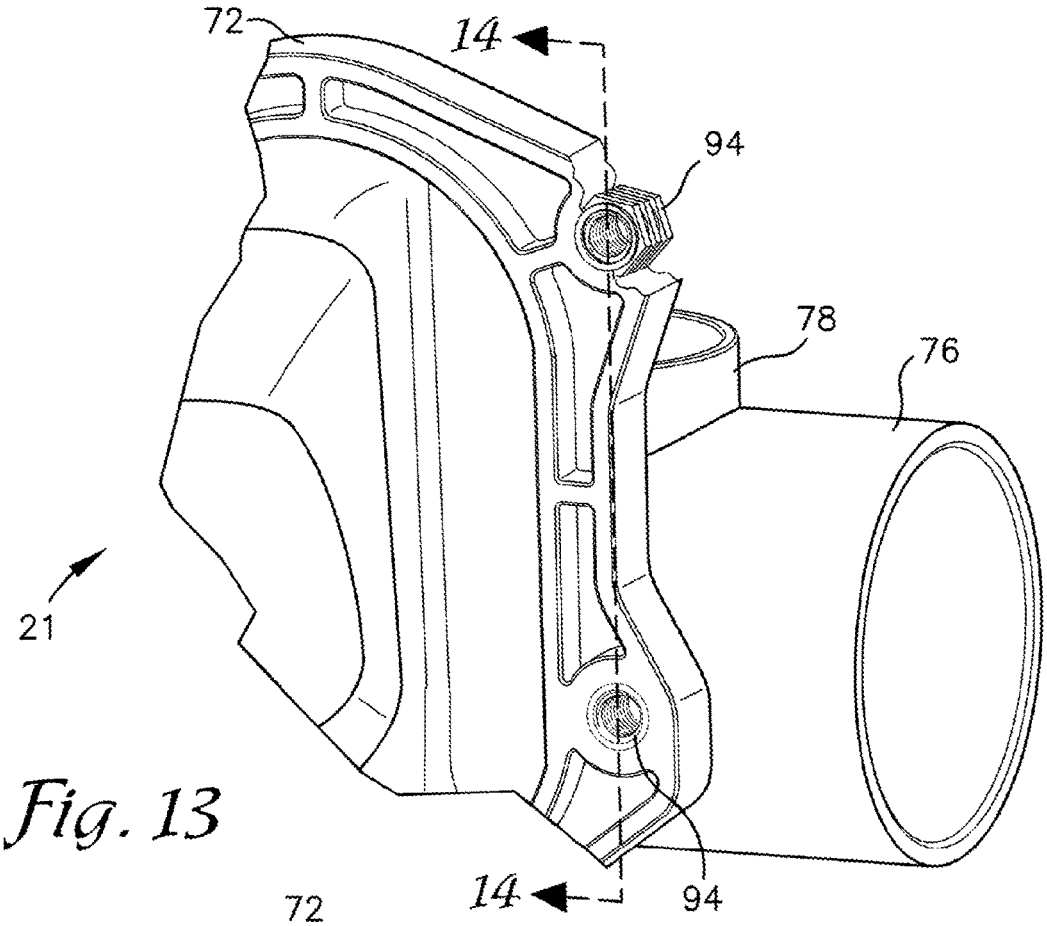
FIG. 13 is a fragmentary, front perspective view of the drain body fitting of the water closet carrier assembly in FIG. 2 with portions broken away to show a metal nut insert molded into the top right side of the mounting flange.
Figure 14:
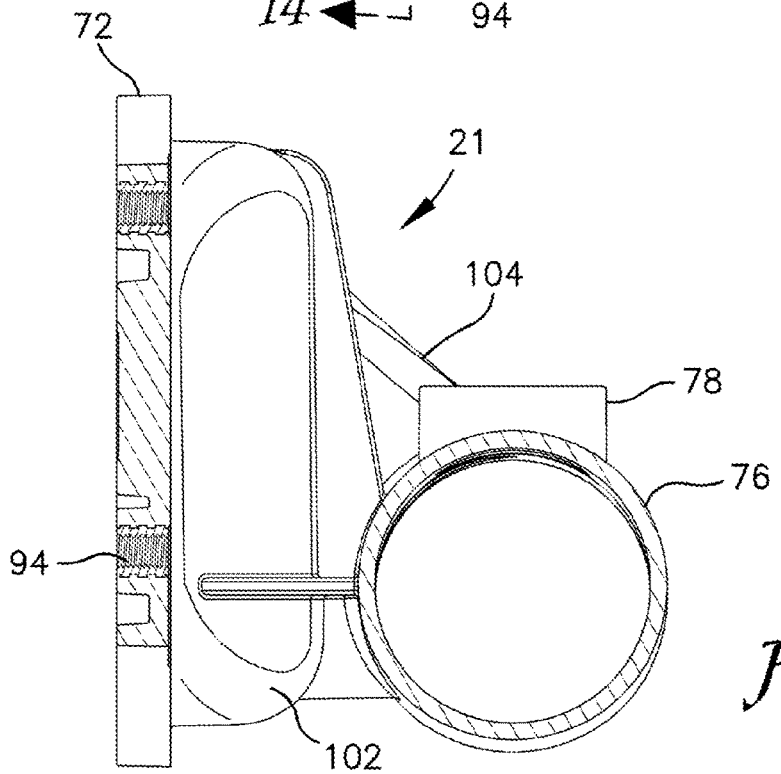
FIG. 14 is a cross-sectional view of the drain body fitting taken along line 14-14 of FIG. 13 showing metal nut inserts molded into the drain body fitting.

The ovate inlet opening 20 has a width approximately equal to a diameter of the drain opening 15 through the faceplate 13. An elastomeric fitting gasket 80 is positioned between and forms a seal between the rear face 19 of the faceplate 13 and the mounting flange 72 of the drain body fitting 21. In the preferred embodiment, inner and outer ovate sealing ribs 100 formed on a rear face of the elastomeric fitting gasket 80 form a seal between the rear face of the elastomeric fitting gasket 80 and the mounting flange 72. In the preferred embodiment shown in FIGS. 13 and 14, a plurality of metal nut inserts 94, preferably of a rust-proof material such as zinc or stainless steel, are molded into and secured within the mounting flange 72 of the drain body fitting 21 on each of the left and right sides of the ovate inlet 20 formed therein and in alignment with the vertically oriented fitting slots 28 of the faceplate 13. In the embodiment shown, the metal nut inserts 94 include a plurality of grooves formed circumferentially in an outer surface of the metal nut insert 94 into which plastic may flow during the molding process to fixedly secure the insert 94 in the molded drain body fitting 21. It is foreseen that surface features other than the grooves shown may be formed on or in the outer surface of the metal nut inserts 94 to present abutting surfaces relative to the molded plastic to prevent removal of the metal nut insert 94 from the mounting flange 72 into which the metal nut insert 94 is molded. Other surface features may include one or more ridges, flanges, dimples, projections, holes or the like.

Figure 15:
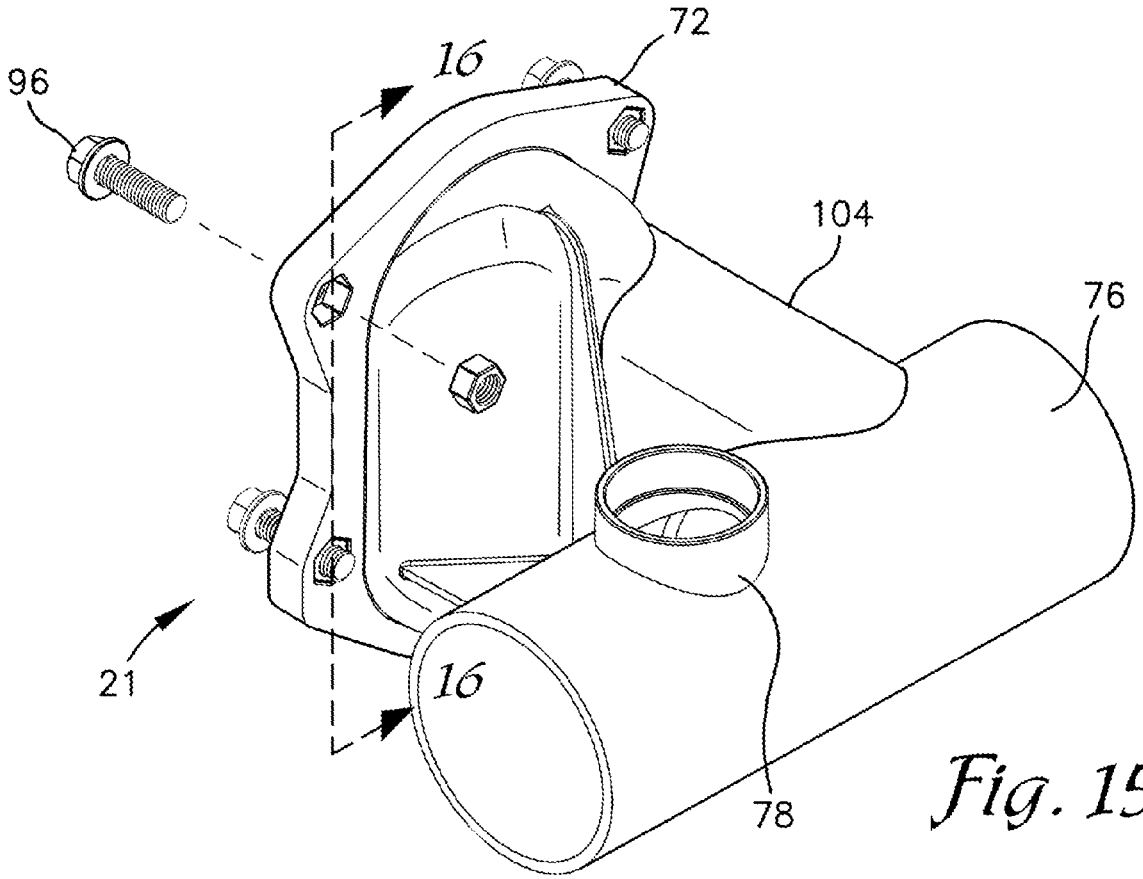
FIG. 15 is an exploded, rear, perspective view of the drain body fitting of the water closet carrier assembly in FIG. 2 showing one of four captured nuts prior to insertion into a mating recess formed in the top left side of the mounting flange.
Figure 16:
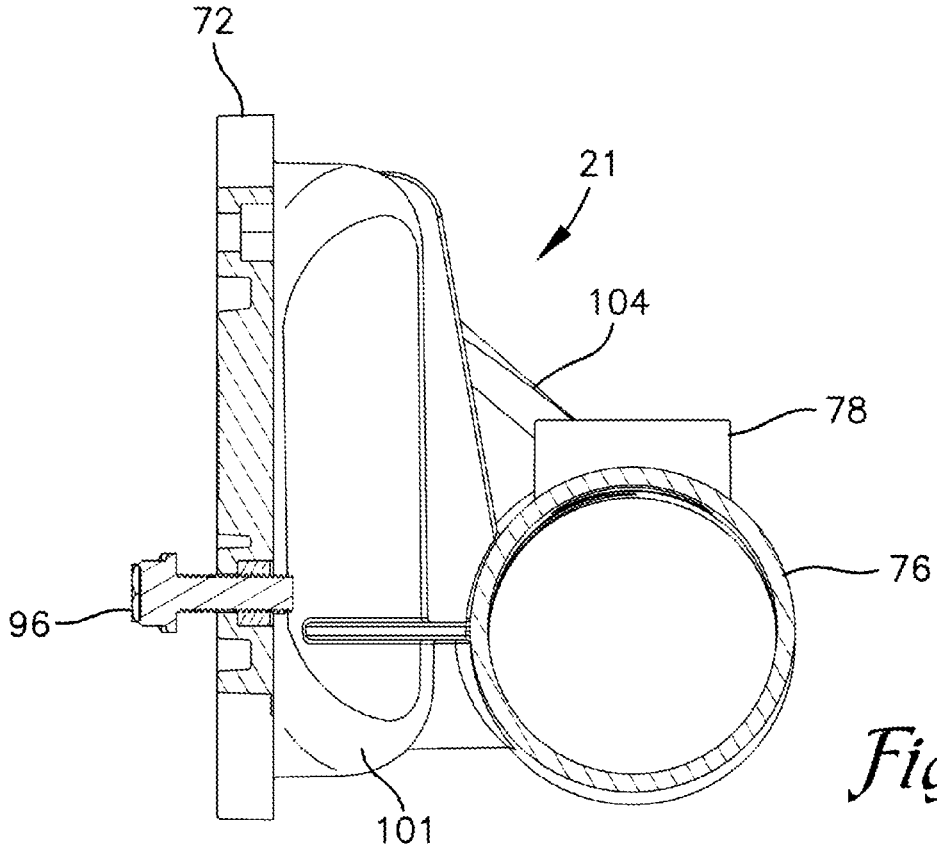
FIG. 16 is a cross-sectional view of the drain body fitting taken along line 16-16 of FIG. 15 showing a captured nut inserted into the mating recess.

Fitting bolts 96 inserted through the vertically oriented fitting slots 28 in faceplate 13 may be aligned with and threaded into the over-molded metal nut inserts 94 of the drain body fitting 21 to secure the drain body fitting 21 to the faceplate 13. In an alternate embodiment shown in FIG. 15 and FIG. 16, the metal nut insert is a captured nut insert insertable within a hexagonal recess formed in the drain body fitting 21. The vertical position of the drain body fitting 21 relative to the faceplate 13 is vertically adjustable. The fitting bolts 96 compress the elastomeric fitting gasket 80 between the rear face 19 of the faceplate 13 and the mounting flange 72 of the drain body fitting 21. It is foreseen that inner and outer ovate grooves may be formed on the front face of the fitting mounting flange 72 for receiving the inner and outer ovate sealing ribs 100 formed on a rear face of the elastomeric fitting gasket 80.

A lower portion of the ovate inlet 120 forms sump section 102 of the drain body fitting 21 and may be spaced below the drain opening 15 through the faceplate 13 and below the closet carrier nipple 17, so that waste from the toilet 11 drops into the sump section 102 before flowing out the throat section 104 and into the waste drain line connection conduit 76 through a throat outlet which reduces the likelihood of effluent flowing backwards into the toilet 11. The throat section 104 slopes downward and angles toward the waste drain line connection conduit 76 at an angle toward the direction of the flow in the laterally extending waste drain line connection conduit 76. To optimize effluent flow, a height of a throat inlet 106 is maximized and the throat section 104 is angled toward the waste drain line connection conduit 76 to reduce or minimize the angular transition of the flow path of effluent from the drain opening 15 into the throat section 104 and from the throat section 104 into the waste drain line connection conduit 76. For optimal effluent flow the angle of the throat section 104 relative to a plane extending across the ovate inlet 120 is preferably greater than approximately 20° and preferably between approximately 20° and 45°. In the embodiment shown the angle of the throat section 104 relative to the plane extending across the ovate inlet is approximately 39°. The throat section 104 tapers from the throat inlet 106 to the throat outlet such that a cross-sectional area of the throat section 104 in a vertical plane proximate an interface between the throat outlet and the waste drain line connection conduit 76 is smaller than a cross-sectional area of the throat inlet 106 taken across a vertical plane through the throat inlet and smaller than a cross-sectional area of the throat section 104 in a vertical plane proximate the throat inlet 106.

In a preferred embodiment, the waste drain line connection conduit 76 has a vent aperture or vent opening 125 formed therein and a vent hub 78 or vent aperture hub 78 surrounding the vent opening 125. The vent opening 125 and vent hub 78 are formed on the drain line connection conduit 76 upstream of the intended direction of effluent flow through the drain line connection conduit 76. The vent hub 78 is sized for connection thereto of a vent pipe 128 for a building venting system. The embodiment shown in the figures incorporates a left-handed drain body fitting 21, but it would be understood by a person having ordinary skill in the art that the drain body fitting 21 could be made in different configurations, including right-handed and back-to-back configurations.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. A water closet carrier assembly for supporting a wall-mounted toilet and flow connecting the wall-mounted toilet to a waste drain line comprises:

a faceplate having a front face, an opposingly directed rear face, a drain opening extending through the faceplate, and at least one vertically oriented faceplate slot extending on each side of the drain opening; and a drain body fitting having a mounting flange surrounding an ovate inlet, wherein the ovate inlet has a width approximately equal to or greater than a diameter of the drain opening through the faceplate, the ovate inlet is formed in an inlet section of the drain body fitting and flow connected to a laterally extending waste drain line connection conduit, the drain body fitting is formed from plastic, the waste drain line connection conduit is sized for connection to the waste drain line on each end of the waste drain line connection conduit, and the mounting flange is securable to the faceplate via a first threaded nut formed from metal and secured in the mounting flange on a left side of the ovate inlet and a second threaded nut formed from metal and secured in the mounting flange on a right side of the ovate inlet and a bolt extending through each of the at least one vertically oriented faceplate slot and threaded into a respective one of the first threaded nut and the second threaded nut.

2. The water closet carrier assembly as in claim 1, wherein the drain body fitting is integrally formed with the waste drain line connection conduit.

3. The water closet carrier assembly as in claim 1, wherein the drain body fitting is molded from plastic.

4. The water closet carrier assembly as in claim 1, wherein each of the first threaded nut and the second threaded nut is alignable with one of the at least one vertically oriented faceplate slots on a respective side of the drain opening such that the mounting flange is adjustably securable to the faceplate.

5. The water closet carrier assembly as in claim 1, wherein each of the first threaded nut and the second threaded nut is molded into the mounting flange.

6. The water closet carrier assembly as in claim 1, further comprising a vent aperture hub formed in an upper portion of the waste drain line connection conduit, wherein the vent aperture hub is sized to receive and connect to an end of a vent pipe.

7. The water closet carrier assembly as in claim 1, wherein the ovate inlet includes a sump section configured to be spaced below the drain opening, the sump section is configured such that waste drops into the sump section from the drain opening, and the sump section is flow connected to a throat section positioned between the sump section and the waste drain line connection conduit, wherein the throat section is angled toward the waste drain line connection conduit and a first axis extending through the throat section extends at an angle of between approximately 20° and 45° relative to a vertical plane extending across the ovate inlet.

8. The water closet carrier assembly as in claim 1, further comprising a throat section in the drain body fitting angled toward the waste drain line connection conduit, the throat section including a throat inlet and a throat outlet wherein the throat outlet is formed at an interface between the throat section and the waste drain line connection conduit and the throat section tapers from the throat inlet to the throat outlet such that a cross-sectional area of the throat outlet is smaller than a cross-sectional area of the throat inlet.

9. A water closet carrier assembly for supporting a wall-mounted toilet and flow connecting the wall-mounted toilet to a waste drain line comprises:

a faceplate having a front face and an opposingly directed rear face through which a drain opening extends and at least one vertically oriented faceplate slot extending on each of opposite sides of the drain opening; and a drain body fitting having a mounting flange surrounding an ovate inlet flow connected to a waste drain line connection conduit, the ovate inlet having a width approximately equal to or greater than a diameter of the drain opening, wherein the drain body fitting is formed from plastic and includes a plurality of threaded nuts formed from metal and secured into the mounting flange and alignable with the at least one vertically oriented faceplate slot such that the drain body fitting is adjustably securable to the faceplate via bolts that each extend through the at least one vertically oriented faceplate slot and are threaded into a respective one of the plurality of threaded nuts.

10. The water closet carrier assembly as in claim 9, further comprising first and second legs securable to the faceplate along left and right sides of the faceplate, respectively, wherein each of the first and second legs has a vertically extending mounting flange with at least one vertically oriented leg slot formed therethrough such that each vertically extending mounting flange is securable against a front or rear face of the faceplate, and the at least one vertically oriented leg slot on each of the first and second legs includes a bolt insertable therethrough and threadingly securable to a respective threaded receiver in the faceplate such that a height of the faceplate relative to the first and second legs is adjustable, and a toilet mounting bolt extendable through the at least one vertically oriented leg slot in each of the first and second legs, each toilet mounting bolt threadingly securable to a respective threaded receiver in the faceplate.

11. A water closet carrier assembly for supporting a wall-mounted toilet and flow connecting the wall-mounted toilet to a waste drain line comprises:

a faceplate having a front face and an opposingly directed rear face through which a drain opening extends and at least one vertically oriented faceplate slot extending on each of opposite sides of the drain opening;

a drain body fitting having a mounting flange surrounding an ovate inlet flow connected to a waste drain line connection conduit, the ovate inlet having a width approximately equal to or greater than a diameter of the drain opening, wherein the drain body fitting is formed from plastic and includes a plurality of threaded inserts secured into the mounting flange and alignable with the at least one vertically oriented faceplate slot such that the drain body fitting is adjustably securable to the faceplate;

first and second legs securable to the faceplate along left and right sides of the faceplate, respectively, wherein each of the first and second legs has a vertically extending mounting flange with at least one vertically oriented leg slot formed therethrough such that each vertically extending mounting flange is securable against a front or rear face of the faceplate, and the at least one vertically oriented leg slot on each of the first and second legs includes a bolt insertable therethrough and threadingly securable to a respective threaded receiver in the faceplate such that a height of the faceplate relative to the first and second legs is adjustable, and a toilet mounting bolt extendable through the at least one vertically oriented leg slot in each of the first and second legs, each toilet mounting bolt threadingly securable to a respective threaded receiver in the faceplate; and first and second feet removably securable to the first and second legs, respectively, wherein each of the first and second legs includes a transverse support flange extending transverse to the vertically extending mounting flange and each of the first and second feet includes a vertical mount and a horizontally extending base, the vertical mount includes a receiving slot sized to receive a projection formed on and projecting laterally from the transverse support flange and the horizontally extending base extends rearward from the vertical mount.

12. A water closet carrier assembly for supporting a wall-mounted toilet and flow connecting the wall-mounted toilet to a waste drain line comprises:

a faceplate having a front face and an opposingly directed rear face through which a drain opening extends and at least one vertically oriented faceplate slot extending on each of opposite sides of the drain opening;

a drain body fitting having a mounting flange surrounding an ovate inlet flow connected to a waste drain line connection conduit, the ovate inlet having a width approximately equal to or greater than a diameter of the drain opening, wherein the drain body fitting is formed from plastic and includes a plurality of threaded inserts secured into the mounting flange and alignable with the at least one vertically oriented faceplate slot such that the drain body fitting is adjustably securable to the faceplate;

first and second legs securable to the faceplate along left and right sides of the faceplate, respectively, wherein each of the first and second legs has a vertically extending mounting flange with at least one vertically oriented leg slot formed therethrough such that each vertically extending mounting flange is securable against a front or rear face of the faceplate, and the at least one vertically oriented leg slot on each of the first and second legs includes a bolt insertable therethrough and threadingly securable to a respective threaded receiver in the faceplate such that a height of the faceplate relative to the first and second legs is adjustable, and a toilet mounting bolt extendable through the at least one vertically oriented leg slot in each of the first and second legs, each toilet mounting bolt threadingly securable to a respective threaded receiver in the faceplate; and first and second feet removably securable to the first and second legs respectively, wherein each of the first and second feet includes a horizontally extending base extending rearward having a rearward foot anchoring hole formed proximate a distal end of the horizontally extending base, wherein the rearward foot anchoring hole of each foot is positioned rearward of the waste drain line connection conduit.

13. The water closet carrier assembly as in claim 9, wherein the plurality of threaded nuts is molded into the mounting flange.

14. The water closet carrier assembly as in claim 9, wherein the ovate inlet includes a sump section flow connected to a throat section in the drain body fitting, wherein the throat section is angled toward the waste drain line connection conduit and a first axis extends through the throat section at an angle greater than 20° relative to a vertical plane extending across the ovate inlet.

15. The water closet carrier assembly as in claim 9, further comprising a throat section in the drain body fitting angled toward the waste drain line connection conduit and having a throat inlet and a throat outlet, wherein the throat outlet is formed at an interface between the throat section and the waste drain line connection conduit, and the throat section tapers from the throat inlet to the throat outlet such that a cross-sectional area of the throat outlet is smaller than a cross-sectional area of the throat inlet.

16. The water closet carrier assembly as in claim 9, further comprising a vent aperture hub formed in an upper portion of the waste drain line connection conduit, the vent aperture hub sized to receive and connect to an end of a vent pipe.

17. A water closet carrier assembly for supporting a wall-mounted toilet and flow connecting the wall-mounted toilet to a waste drain line comprises:

a faceplate having a front face, an opposingly directed rear face, and a drain opening extending through the faceplate; and a drain body fitting molded from plastic and integrally formed with a waste drain line connection conduit, the drain body fitting having a mounting flange configured to be adjustable secured to the faceplate, the mounting flange surrounding an ovate inlet that includes a sump section configured to be spaced below the drain opening and a throat section extending from the sump section and angled toward a direction of flow in the waste drain line connection conduit, wherein the mounting flange includes a plurality of threaded nuts formed from metal and secured therein, and the mounting flange is securable to the faceplate via bolts extending therethrough and threaded into the plurality of threaded nuts.

18. The water closet carrier assembly as in claim 17, further comprising first and second legs adjustably securable to the faceplate along left and right sides thereof, wherein each of the first and second legs have a vertically extending mounting flange with at least one vertically oriented leg slot formed therethrough such that each vertically extending mounting flange is adjustable securable to the faceplate and each of the first and second legs having a transverse support flange extending transverse to the vertically extending mounting flange.

19. A water closet carrier assembly for supporting a wall-mounted toilet and flow connecting the wall-mounted toilet to a waste drain line comprises:

a faceplate having a front face, an opposingly directed rear face, and a drain opening extending through the faceplate;

a drain body fitting molded from plastic and integrally formed with a waste drain line connection conduit, the drain body fitting having a mounting flange configured to be adjustable secured to the faceplate, the mounting flange surrounding an ovate inlet that includes a sump section configured to be spaced below the drain opening and a throat section extending from the sump section and angled toward a direction of flow in the waste drain line connection conduit;

first and second legs adjustably securable to the faceplate along left and right sides thereof, wherein each of the first and second legs have a vertically extending mounting flange with at least one vertically oriented leg slot formed therethrough such that each vertically extending mounting flange is adjustable securable to the faceplate and each of the first and second legs having a transverse support flange extending transverse to the vertically extending mounting flange; and first and second feet removably securable to each of the first and second legs, respectively, the first and second feet each including a vertical mount and a horizontally extending mount, wherein the vertical mount is removably securable to the transverse support flange and the horizontally extending mount includes an anchoring hole configured to be positioned rearward of the waste drain line connection conduit.

20. The water closet carrier assembly as in claim 17, wherein the drain body fitting includes the plurality of threaded nuts molded therein and alignable with at least one vertically oriented faceplate slot formed on each side of the drain opening in the faceplate such that the drain body fitting is adjustably securable to the faceplate.

21. The water closet carrier assembly as in claim 17, further comprising a vent aperture hub formed in an upper portion of the waste drain line connection conduit, the vent aperture hub sized to receive and connect to an end of a vent pipe.

* * * * *